US006163257A

United States Patent [19]

Tracy

[11] Patent Number: 6,163,257

[45] Date of Patent: Dec. 19, 2000

[54] SECURITY SYSTEM HAVING EVENT DETECTORS AND KEYPADS WITH INTEGRAL MONITOR

[75] Inventor: Lawrence Robert Tracy, Auburn, Calif.

[73] Assignee: Detection Systems, Inc., Fairport, N.Y.

[21] Appl. No.: 08/958,591

[22] Filed: Oct. 29, 1997

Related U.S. Application Data

[60] Provisional application No. 60/030,259, Oct. 31, 1996.

[51] Int. Cl.[7] ..... G08B 29/00

[52] U.S. Cl. ..... 340/506; 340/524; 340/525; 340/825.06; 348/143; 348/150

[58] Field of Search ..... 340/517, 524, 340/525, 531, 541, 565, 691, 825.06, 825.31; 348/143, 149, 150, 154, 155, 152; 379/37, 43, 44

[56] References Cited

U.S. PATENT DOCUMENTS

| | | | |
|---|---|---|---|
| 4,651,143 | 3/1987 | Yamanaka | 340/691 |
| 4,991,008 | 2/1991 | Nama | 358/108 |
| 5,144,661 | 9/1992 | Shamosh et al. | 380/9 |
| 5,412,708 | 5/1995 | Katz | 348/14 |
| 5,455,561 | 10/1995 | Brown | 340/541 |

*Primary Examiner*—Daryl Pope

*Attorney, Agent, or Firm*—J. Addison Mathews

[57] ABSTRACT

A security system includes cameras disposed for activation by components of the system to record images of activity detected by the components. The system responds to a keypad and/or communications from a public switched telephone network to present the images for viewing. A system according to the invention supports visual verification of false alarms, tracking of arrivals and departures and recording those who arm and disarm the system. Visual verification also can be used in connection with remote notifications or authorizations of entry to the secured area.

15 Claims, 4 Drawing Sheets

SECURITY SYSTEM HAVING EVENT DETECTORS AND KEYPADS WITH INTEGRAL MONITOR

CROSS REFERENCE

Priority is claimed based on my U.S. provisional application Serial No. 60/030,259, filed Oct. 31, 1996.

DESCRIPTION

1. Field of Invention

The invention relates to security systems including devices for capturing images of detected events and for displaying captured images on a keypad or through a private or public network, either analog or digital.

2. Background of the Invention

A typical security system includes multiple event detectors, keypads and alarms linked to a control panel by wire or radio frequency signals. Contacts positioned at doors and windows change their normally open or closed state in response to an entry or exit, motion detectors sense activity and fire detectors respond to heat or smoke. When such predetermined events are detected, signals are sent to the control panel and the panel activates a sounder, strobe or other appropriate alarm. In many systems, monitored by a commercial service, the control panel calls and reports the detected events to the service over a communications network, often a public switched telephone network. The keypads provide for inputs to the system, such as arming or disarming, and display system status, usually through light emitting diodes (LEDs) or liquid crystal displays (LCDs).

It also is known to provide cameras and remote monitors in the same protected area with such systems, particularly in banks and other commercial enterprises. The cameras operate automatically to capture and temporarily store images of the protected area. The images can be used for real time surveillance or to provide evidence after a security violation.

SUMMARY OF THE INVENTION

The present invention is directed to improvements in security systems including devices for capturing and displaying images of detected events. Briefly summarized, according to one aspect of the invention, a security system having event detectors is provided with cameras disposed for capturing images of detected events. More specific features employ the event detectors to activate the cameras to capture the detected event. Still more specifically, the system includes a keypad that displays the images for viewing.

According to other aspects of the invention, a security system is provided with cameras disposed for activation by system components to record images of events detected by the components and the system is linked for communication with a public or private network. The system responds to communications from the network to transmit the images on the network.

Still other aspects of the invention relate to a security system keypad including input keys, a display and a camera. The input keys generate control signals for the security system, the display presents system status information and the camera captures images from the viewpoint of the housing. According to more specific features of this aspect, a presence detector is disposed to detect a human approach to the housing, and operates the camera to capture the images in response to the human approach.

Still another aspect of the invention relates to an event detector selected from a group comprising fire event detectors and intrusion event detectors and including a camera supported by the housing disposed for capturing an image of a detected event. More specifically, the detector activates the camera to store the captured image in response to a detected event.

A system according to the invention provides for visual verification of false alarms, tracking of arrivals and departures and recording of those who arm and disarm the system. Visual verification also can be used in connection with remote notifications or authorizations of entry to the secured area. A parent at work, for example, can visually confirm a child's return to home after school or other outside activities.

These and other features and advantages of the invention will be more clearly understood and appreciated from a review of the following detailed description of the preferred embodiments and appended claims, and by reference to the accompanying drawings.

DETAILED DESCRIPTION OF THE INVENTION

Figure 1:
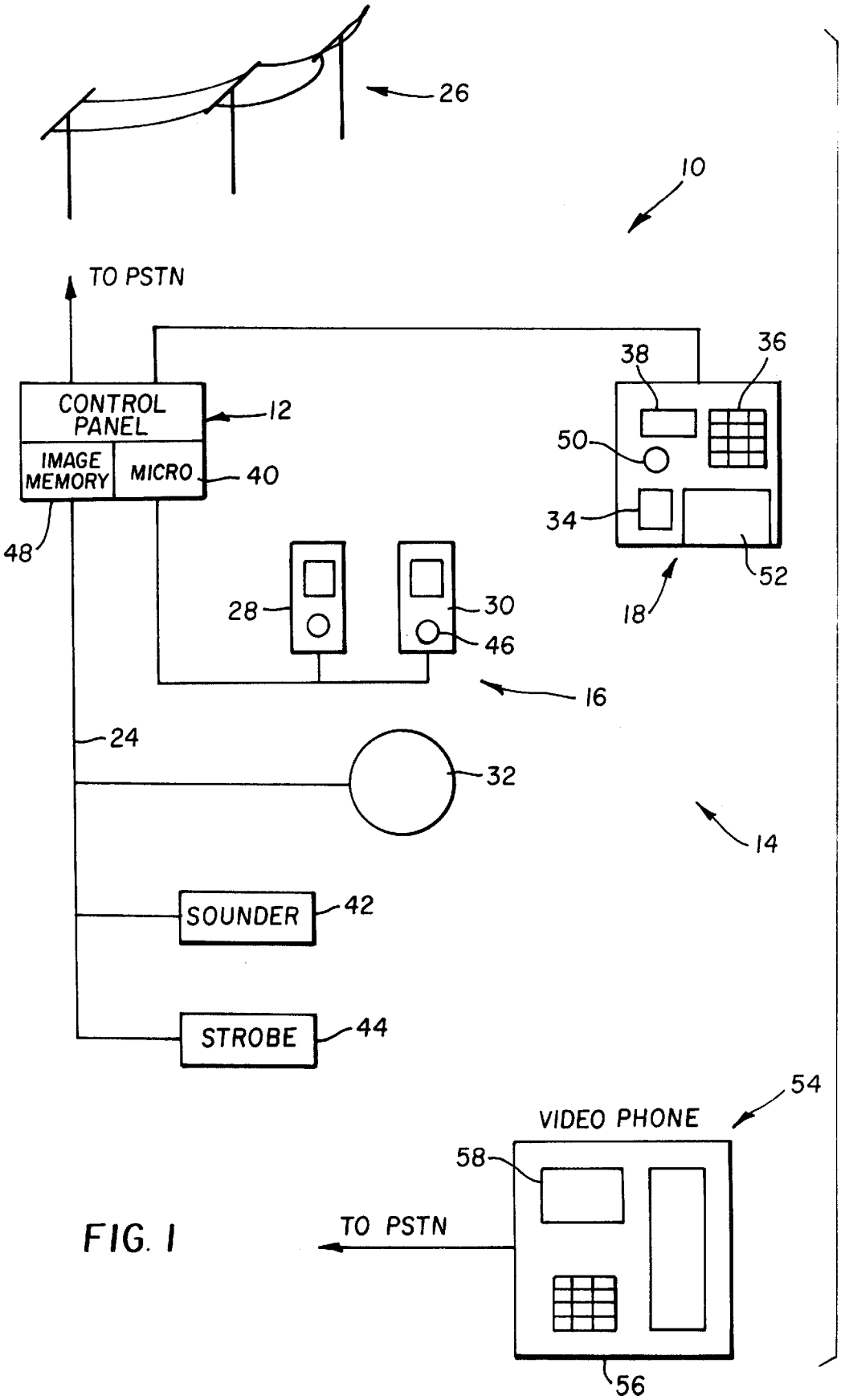
FIG. 1 is a schematic view of a security system according to a preferred embodiment of the invention.

Referring now to FIG. 1, a preferred security system 10 is depicted comprising a control panel 12 and multiple components 14, including event detectors 16 and communications interface 18.

The components 14 are linked by conductors 24 to the control panel 12, but other communications links, such as wireless radio frequency or infrared transmitters and receivers clearly are within the scope of the invention. The control panel also is linked to a private or public network 26, such as a public switched telephone network (PSTN) again by hard wired or wireless devices. Private data networks, internet and intranet links, ISDN and T1 lines, frame relays and other appropriate communications approaches, alone or in combination, are examples of other communications approaches that might be employed.

Event detectors 16 include a wide variety of technologies and devices for detecting security related events, such as intrusion or a fire. Illustrated in the preferred embodiment are motion detectors 28 and 30, fire detector 32, and a presence detector 34. Motion detectors 28 and 30 are depicted as passive infrared devices that sense radiation in wavelengths corresponding to heat emitted by humans. When an intruder moves across the field of view of the detector, it senses the temperature change, relative to the background, compares the signal to certain predetermined criteria and, when there is a match, sends an alarm signal to the control panel 12. Fire detector 32 senses the dispersion of light from smoke and other atmospheric particles typically associated with a fire. Presence detector 34 is similar to an intruder detector, but with reduced capabilities, for detecting the approach of a human to the communications interface. A communications interface with such a presence detector is described more fully in commonly assigned patent application Ser. No. 08/958,592, entitled Security System Keypad Illuminated By Proximate Motion, filed on even date herewith, the disclosure of which hereby is incorporated by reference into the present specification. Other event detectors within the scope of the invention include active motion detectors, such as microwave detectors, fire detectors based on heat or smoke, door and window contacts, panic buttons and other detectors of events associated with the security of a structure or its occupants.

Communications interface 18 typically is a keypad having alpha-numeric elements 36 and status indicators 38. The alpha-numeric elements provide for inputs to the control panel 12 to arm, disarm or partially arm the system and to identify authorized individuals through a personal identification number (PIN). The status indicators are LEDs and LCDs that visually report the status of the system.

The control panel 12 includes appropriate interface devices operated by microcontroller 40 for communicating with and between the system components 14 and the network 26. When an alarm is reported from one or more of the detectors, the microcontroller 40 activates sounders 42 and strobes 44 and calls a commercial monitoring service over the network 26.

Referring now more specifically to the features of the present invention, the security components 14 are provided with miniature imaging devices, such as still or video cameras employing charge coupled devices (CCDs) or other appropriate image capturing technologies. The motion detector 28, for example, includes a camera 46 that is activated for a predetermined period when motion is detected by the detector 28. The camera 46 is disposed to view approximately the same area covered by the detector, and, when activated, records one or more images of the detected activity. The recorded image(s) is then stored for a predetermined period, preferably in image memory 48 in the control panel.

Keypad 18 likewise includes a camera 50 that is activated by presence detector 34, or by use of the keypad 18, and sends the recorded image(s) to the control panel memory 40. In addition to the camera 42, keypad 22 includes a flat panel display 52 for presenting the captured images in still frame or video in response to an authorized command entered through the keyboard. An authorized user thus can use the system to confirm alarms visually and to track those who use the keypad to arm or disarm the system. Similarly, images can be used to record access to the premises and the possessions of those who enter or leave the premises.

The invention has particular utility when combined with the capability to transmit the captured images over network 26, and to control the system from remote terminals. A video phone 54, including a keypad 56 and display 58, is an example of a device that can be used to control the system remotely to take alternative actions depending on the viewed images. A child returning from school might activate the system at the keypad 18, by entering an identification number and disarming the system. A parent with a video phone then could visually confirm that the child entered the house alone.

Figure 2:
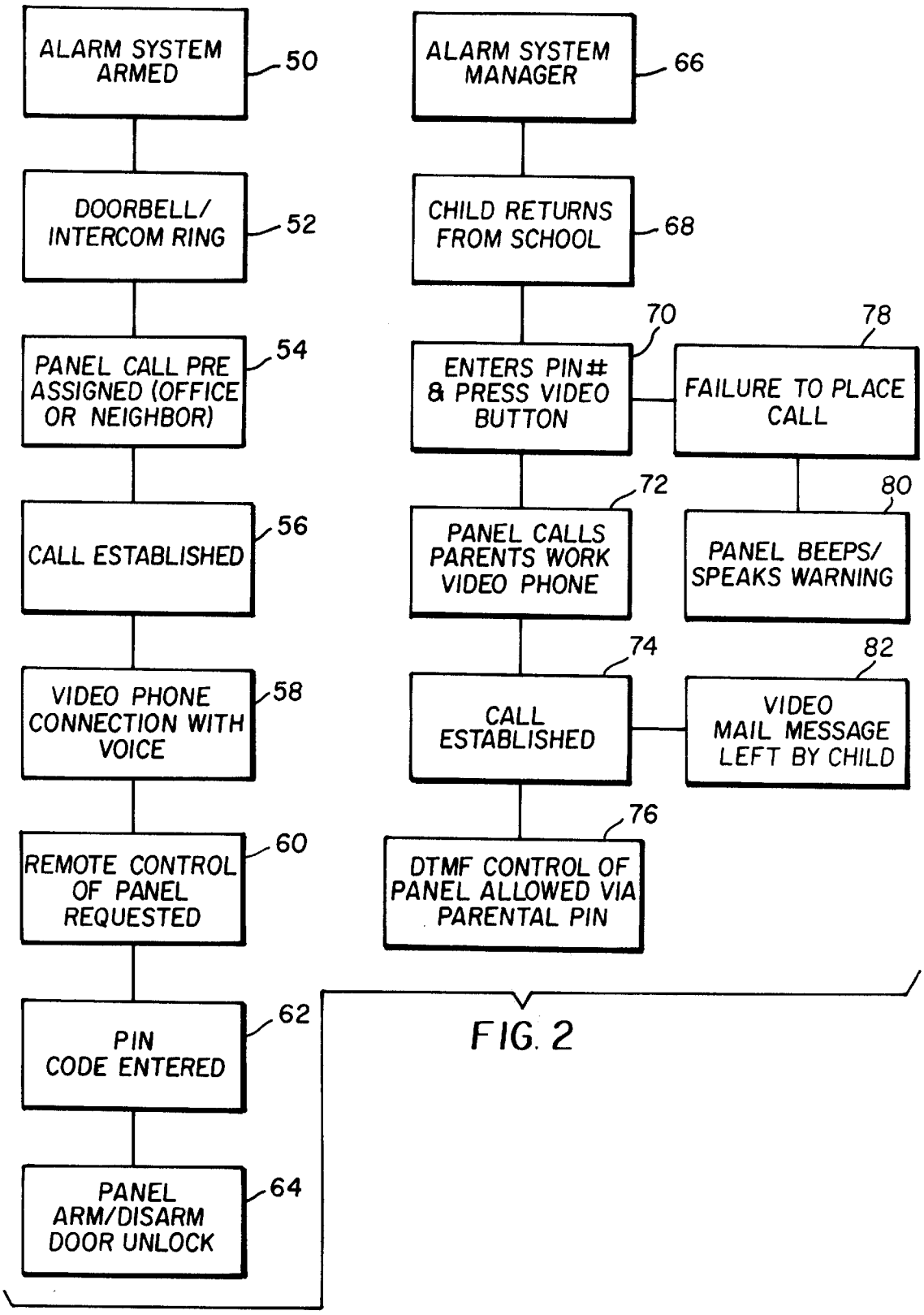
FIG. 2 is a flow diagram depicting the operation of the preferred security system of FIG. 1.

Referring now to FIG. 2, a flow diagram depicts certain operational features of the preferred embodiment. When the system is armed, box 60, and a visitor activates the system, box 62, the control panel 12 calls a pre assigned number, boxes 64 and 66 having a video phone, box 68. The recipient of the call can then view the transmitted image and control the panel remotely, box +0, after entering an appropriate identification, box 72. The panel can be disarmed and the door unlocked, box 74, assuming, of course, the visitor is known to the recipient.

A similar operation is depicted beginning at box 76, when a child returns from school, box 78. The child enter a pin number, box 80, and activates the image capture device in the keypad 18. The panel calls the parents at work, box 82, and the system is controlled by the parent from the remote location, boxes 84 and 86. If the call is not completed, the system remains armed and/or leaves a message, boxes 88, 90 and 92.

Figure 3:
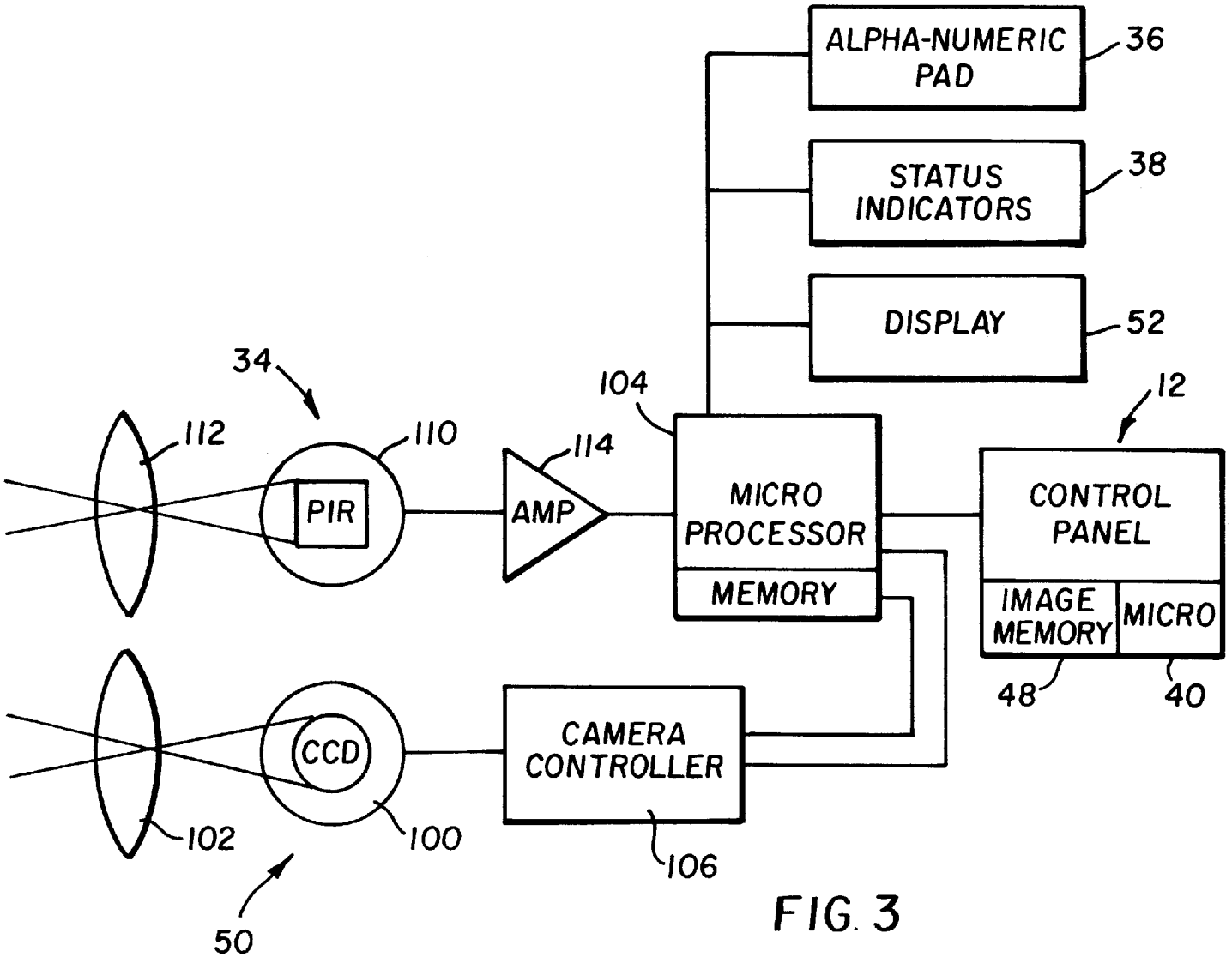
FIG. 3 is a block diagram of a security interface device, such as a keypad, in accordance with the preferred security system of FIG. 1.
Figure 4:
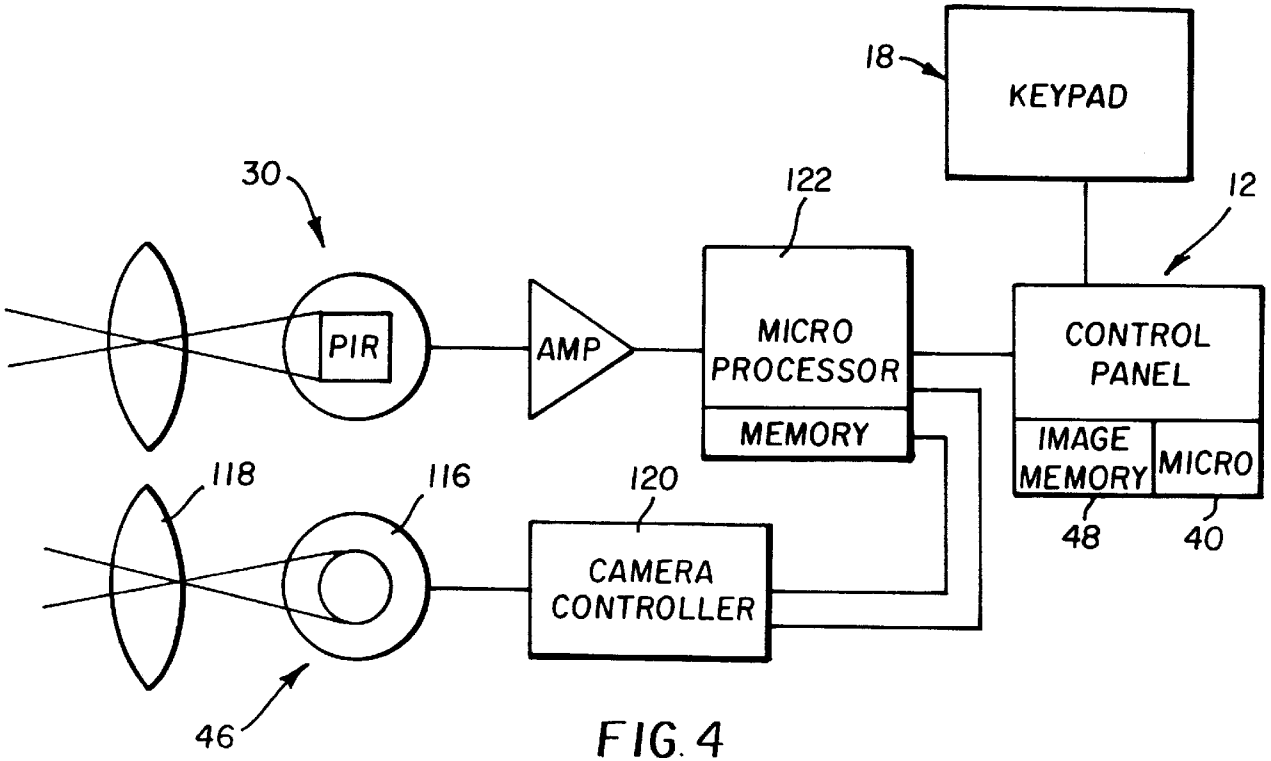
FIG. 4 is a block diagram of an event detector, such as a fire detector or intrusion detector, in accordance with the preferred security system of FIG. 1.

More specific features of the preferred embodiment are illustrated on FIGS. 3 and 4. FIG. 3 depicts the preferred keypad 18 including presence detector 34 and camera 50 coupled through the keypad to alarm panel 12. Camera 50 uses a charge coupled device 100 for capturing images from the viewpoint of the keypad through optics 102. The camera is normally off until activated by presence detector 34, sensing an approaching human, or through the operation of alpha-numeric pad 36. Microprocessor 104 then initiates operation of the camera through controller 106 and directs the recorded images to the alarm panel 12 for storage and further communication as described above. Alternatively, the camera 50 may record images continuously in a temporary storage. Activation by presence detector 34, or use of alpha-numeric pad 36, then initiates the capture and more permanent storage of one or more images surrounding the presence detection or pad use. Capture periods might include, for example, from two minutes before until two minutes after the detected event.

In addition to simple imaging, camera 50 may be used for video image verification, including fingerprint verification and bio-verification.

The detecting components of motion detector 30, FIG. 4, include a passive infrared sensor 110, optics 112 and amplifier 114. The camera components include CCD sensor 116, optics 118 and controller 120. When an intruder is detected, microprocessor 122 and controller 120 initiate operation of the camera and communication of the resulting images to control panel 12.

Figure 5:
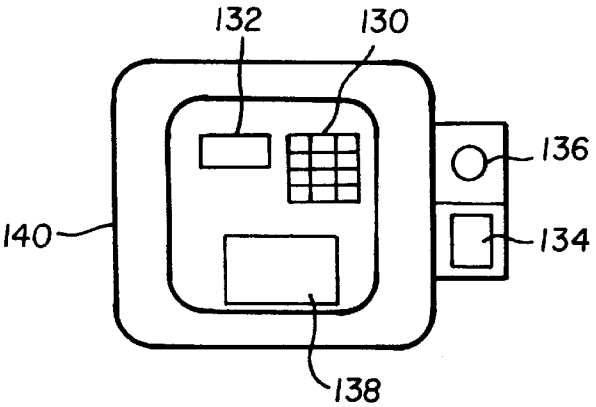
FIG. 5 is a schematic view of an alternative security interface device.

An alternative embodiment of the keypad is depicted in FIG. 5. Although it is similar in many respects to the keypad already described, including an alpha-numeric pad 130, status indicators 132, presence detector 134, camera 136 and display 138, one or more of these elements are presented visually on a touch sensitive monitor 140.

It should now be apparent that a security system according to the invention includes cameras disposed for activation by components of the system to record images of activity detected by the components. The system responds to a keypad to present the images for viewing and/or to communications over a public switched telephone network.

While the invention is described in connection with a preferred embodiment, other modifications and applications will occur to those skilled in the art. The claims should be interpreted to fairly cover all such modifications and applications within the true spirit and scope of the invention.

PARTS LIST

Reference No. Part

10. Security system.
12. Control panel.
14. Components.
16. Event detectors.
18. Communications interface

24. Conductors.
26. Network.
28, 30. Motion detectors.
32. Fire detector.
34. Presence detector.
36. Alpha-numeric pad.
38. Status indicator.
40. Microcontroller.
42. Sounder.
44. Strobe.
46. Camera.
48. Image memory.
50. Camera.
52. Display.
54. Video phone.
56. Keypad(s).
58. Display.
100. Charge coupled device.
102. Optics.
104. Microprocessor.
106. Controller.
110. Sensor.
112. Optics.
114. Amplifier.
116. Sensor.
118. Optics.
120. Controller.
122. Microprocessor.
130. Alpha-numeric pad.
132. Status indicators.
134. Presence detector.
136. Camera.
138. Display.
140. Touch sensitive monitor.

What is claimed is:

1. A security system including a control panel and multiple components linked within a protected region for communicating with said panel, said components including an activity detector and a local keypad within the protected region for arming and disarming the system, characterized in that:

a camera is disposed for activation by said activity detector to capture an image of activity in the vicinity of said detector;

at least a respective one of said multiple components and control panel includes memory recording said captured image; and, an image display is associated with said local keypad and controlled through said keypad to display said recorded image for viewing at said keypad.

2. The invention of claim 1, wherein said activity detector and said camera are in one housing and wherein said keypad and said display are in another housing.

3. The invention of claim 2, wherein said system is linked for communication with a public switched telephone network and responds to communications from said network to transmit said stored image on said network.

4. A security system in a protected facility and including in said facility a control panel, an activity detector linked for communicating with said panel and a local communications pad for arming and disarming said system, said detector having an effective range for detecting activity, characterized in that:

said activity detector includes a camera disposed for capturing images from within said effective detection range;

said camera is activated to capture said images by said activity detector detecting activity;

said panel includes memory for storing said captured images;

said local communications pad includes a display presenting said captured images for viewing at said pad; and, said display is controlled through said local pad for displaying said captured images on demand from said local pad.

5. The invention of claim 4, wherein said local communications pad includes said activity detector and said camera responds to signals initiated by said activity detector to capture said images in response to detection of activity in the vicinity of said local communications pad.

6. The invention of claim 4, wherein said activity detector is an intruder detector.

7. The invention of claim 4, wherein said at least one activity detector is a fire detector.

8. The invention of claim 4, wherein said system is linked for communication with a public switched telephone network and responds to communications from said network to transmit said images on said network.

9. The invention of claim 4, wherein said activity detector and said camera are in one housing and wherein said local communications pad and said display are in another housing.

10. A security system comprising:

a control panel;

a communication link for communicating with said panel;

a plurality of event detectors using said communication link to report events to said panel;

a local keypad using said communication link for controlling said system and displaying system status, said local keypad having:

an integral housing supporting a presence detector detecting human presence approaching said local keypad;

a camera activated by said presence detector to capture an image of approaching human presence; and, an image display;

said system having a control responding to said local keypad to present said captured image on said display.

11. The invention of claim 10, wherein said local keypad communicates said captured images to said control panel in response to said presence detector detecting said approaching human presence.

12. A security system defining a protected region and comprising:

a control panel within said protected region;

a communication link within said protected region for communicating with said panel;

a plurality of event detectors coupled to said communication link, said event detectors selected from a group comprising fire event detectors and intrusion event detectors;

at least one of said event detectors having a housing supporting a camera activated by said at least one event detector and disposed for capturing an image of an event detected by said at least one event detector; and a communications pad within said protected region and coupled to said communication link for controlling said system and displaying system status; said communications pad having an image display and said system having a control for responding to said communications pad to present said captured images on said display.

13. The invention of claim 12, wherein said at least on event detector activates said camera to store said captured image in response to event detection by said event detector.

14. The invention of claim 12, wherein said system further includes a communications link communicating with a public network to transmit said images on said network.

15. A security system keypad for use in a security system; said keypad comprising:

a housing;

a presence detector supported by said housing and detecting human approach to said housing;

input keys supported by said housing and actuatable to generate control signals for the security system;

a display supported by said housing and responding to security system signals to present system status information;

a camera supported by said housing and operative to capture images from the viewpoint of said housing, said presence detector operating said camera to capture said images in response to said human approach; and, a control operated by said input keys for presenting on said display said images captured by said camera.

* * * * *